United States Patent [19]

Vadnais

[11] Patent Number: 4,461,454

[45] Date of Patent: Jul. 24, 1984

[54] CAULKING TUBE VALVE

[75] Inventor: Kenneth Vadnais, Livonia, Mich.

[73] Assignee: New Product, Inc., Southfield, Mich.

[21] Appl. No.: 383,545

[22] Filed: Jun. 1, 1982

[51] Int. Cl.[3] ..... B67B 7/24

[52] U.S. Cl. ..... 251/350; 251/353; 222/521; 222/525; 222/82; 239/272; 239/541; 239/579; 239/583

[58] Field of Search ..... 239/272, 569, 583, 579, 239/541; 251/350, 353; 222/149, 525, 521; D8/14.1; 137/68 R, 71

[56] References Cited

U.S. PATENT DOCUMENTS

| | | | |
|---|---|---|---|
| 193,522 | 7/1877 | Koegler et al. | 239/541 |
| 2,985,385 | 5/1961 | Bowers et al. | 239/583 |
| 3,130,872 | 4/1964 | Myers et al. | 222/82 |
| 3,219,278 | 11/1965 | Santarelli | 251/353 |
| 3,268,123 | 8/1966 | Spatz | 222/559 |
| 3,285,453 | 11/1966 | Wagner | 222/521 |
| 3,489,323 | 1/1970 | Hug | 222/525 |
| 3,554,450 | 1/1971 | D'Muhala | 239/569 |
| 3,714,959 | 2/1973 | Pignataro, Jr. | 137/318 |
| 3,987,939 | 10/1976 | Pedone, Jr. et al. | D8/14.1 |

FOREIGN PATENT DOCUMENTS

| | | | |
|---|---|---|---|
| 345854 | 1/1904 | France | 239/583 |

*Primary Examiner*—A. Michael Chambers
*Attorney, Agent, or Firm*—Reising, Ethington, Barnard, Perry & Milton

[57] ABSTRACT

A two piece valve accessory for common caulking tubes or cartridges insertable in caulking guns is disclosed. The valve permits resealing of the cartridge nozzle, snout or applicator tip without hardening or significant wastage of the material therein and permits increased control of the flow rate of material from the cartridge.

The valve is adjustable from fully open to closed position and includes a separate sealed or dome extended position wherein the residue from the applicator tip of the valve is expelled.

The valve barrel includes an integral piercing edge to break the cartridge seal as the valve is inserted into the applicator tip of the cartridge. The barrel is sized and ribbed for an interference non-rotatable fit within the applicator tip. The valve cap is fully rotatable on the barrel and includes a beveled tip to direct material in any radial direction relative to the caulking gun handle.

In use the valve is opened and caused to remain open by pressure applied to the cartridge by the caulking gun plunger. The valve is closed or fully closed and sealed manually after release of the pressure on the material in the cartridge.

10 Claims, 8 Drawing Figures

CAULKING TUBE VALVE

BACKGROUND OF THE INVENTION

The field of the invention pertains to cartridges and valves for the dispensing of highly viscous materials and, in particular, to valves that can be used to control and seal dispensers for such materials. The materials include common caulking, butyl and silicone sealants as well as a multitude of other materials dispensed from cartridges or caulking tubes inserted in caulking guns.

The typical caulking tube or cartridge type of dispenser comprises a cardboard tube with one metal end sealingly attached to the cardboard tube. A plastic nozzle, snout or applicator tip extends from the metal end. As manufactured and sold the applicator tip is sealed. An additional internal aluminized plastic seal covers the opening through the metal end into the cartridge tip. The other end of the tube includes an internally mounted diaphragm seal or cover that is engageable by the caulking gun plunger to apply pressure to the material in the tube and thereby expel the material through the applicator tip.

Before applying pressure to the diaphragm, the tapered end of the applicator tip is opened and trimmed by the user to provide the desired opening diameter and a nail or other sharp pointed object is inserted to pierce the aluminized plastic seal.

Unfortunately, once the tube or cartridge is opened, the applicator tip can not be properly closed or resealed in a manner that prevents air from entering and causing the material in the applicator tip to harden. Since the applicator tip is tapered, the slug of hardened material becomes difficult to expel. Typically, increased force applied to the plunger causes the cardboard to burst with the result that the material can no longer be properly dispensed from the cartridge.

A second problem with the applicator tip is that once trimmed to a large opening, the opening can no longer be reduced to a smaller cross section for a smaller bead.

A cap to cover the trimmed applicator tip can be applied as provided with some cartridges, however, the cap is removed in use and can easily be mislaid. The cap also permits air to be trapped at the tip thereby permitting hardening of material at the tip to ensue.

U.S. Pat. No. 2,859,932 illustrates a flexible plastic two part valve for inflating or deflating plastic toys. The valve may also be used for controlling the passage of liquids. The patent discloses various means for retaining the valve in a fully closed gas tight position as distinguished from the fully open position. As disclosed the valves are permanently attached as an integral part of the toy or other item with means to attach an air pump or vacuum pump.

With a view toward overcoming the problems noted above, the applicant has developed the valve disclosed and described below.

SUMMARY OF THE INVENTION

The invention comprises a two part valve assembly, the inner barrel portion being extended to an angled piercing end. The outer cap portion is beveled to provide an applicator tip. The valve is intended as an accessory for common caulking tube dispensers or cartridges which are insertable into common caulking guns.

The inner or barrel portion of the valve is partially ribbed or fluted and sized for an interference fit with the inside of a trimmed cartridge applicator tip. The portion of the barrel that fits within the cap portion of the valve is sized and configured in combination with the cap interior to provide smooth adjustment from fully open through closed positions. Further movement beyond the closed position brings a small dome at the cap end of the barrel into the applicator tip to expel residue material from the tip of the valve.

The valve cap and applicator tip may be rotationally positioned relative to the gun as desired. The valve is opened by grasping and manually opening. Opening is assisted by applying pressure with the gun to the material in the cartridge. The valve remains open as long as pressure continues to be applied to the diaphragm. When the gun trigger or handle is released, the valve cap may be manually closed. Since the valve is designed and intended for use with highly viscous caulks, sealants and glues, the material does not squirt out upon the application of pressure and the opening of the valve. Rather, the material flows and forms a bead in a manner similar to the conventional trimmed applicator tip.

To close the valve and cartridge for short periods of non-use, the gun handle or trigger is released to relieve the pressure on the material and the valve cap manually moved to the closed position. When the cartridge is to be stored for an indefinite period of time, the cap is moved to the sealed position wherein the dome extends into the applicator tip thereby expelling residue from the tip and sealing the valve and material from the outside air. The dome on the barrel tip includes a skirt having an interference fit within the applicator tip of the valve. Thus, the valve configuration prevents air from being trapped in the valve and applicator tip and thereby prevents hardening of material in the applicator tip or valve.

DESCRIPTION OF THE PREFERRED EMBODIMENT

Figure 1:
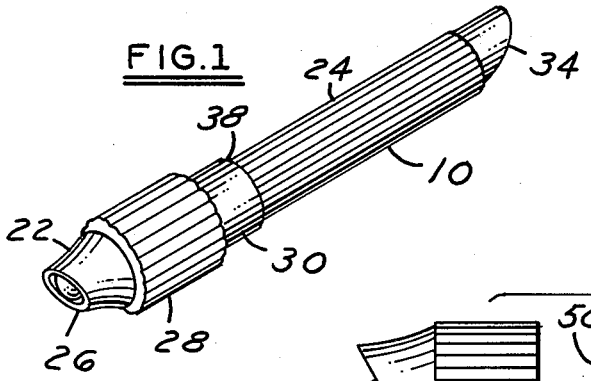
FIG. 1 illustrates the external appearance of the valve in perspective.
Figure 2:
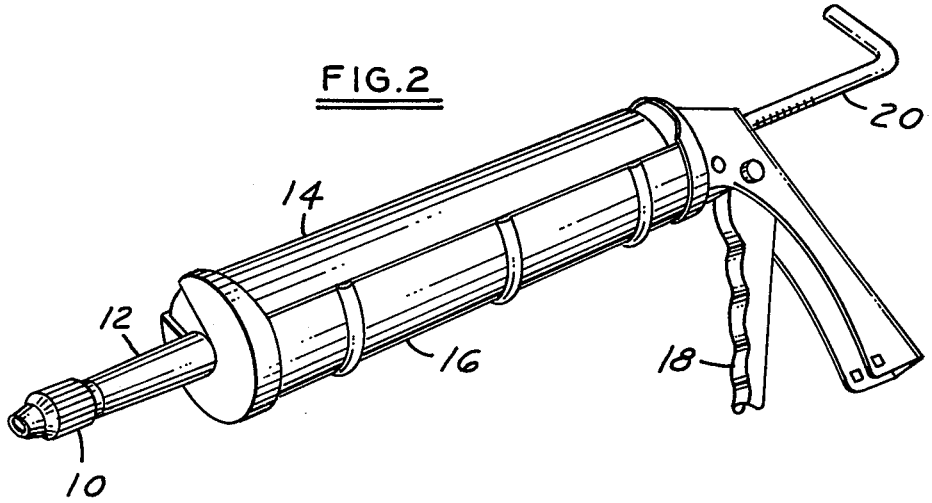
FIG. 2 is a perspective view of the valve inserted in the tip of a cartridge in turn mounted in a caulking tube gun.

As best shown in FIGS. 1 and 2 the valve 10 is insertable into the trimmed applicator tip 12 of a common caulking tube or similar cartridge 14. The cartridge 14 in turn is positioned in a typical caulking gun 16. The cartridge 14 and gun 16 are conventional units operated together by squeezing the gun trigger 18 to cause the plunger rod 20 and piston thereattached (not shown) to move into the cartridge 14. The piston engages and pushes a movable diaphragm seal (not shown) further into the cartridge 14 to thereby pressurize and eject material contained in the cartridge. The material in the cartridge is ejected through the tip 12 and valve 10.

Figure 3:
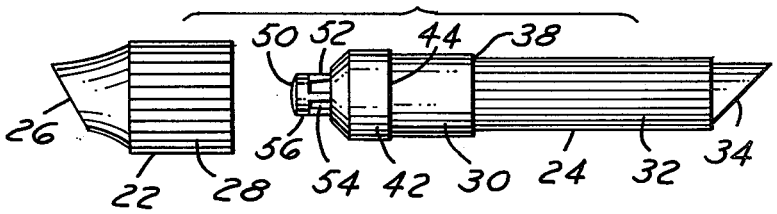
FIG. 3 is an exploded side view of the barrel and cap of the valve.

As illustrated in FIG. 3 the valve comprises a cap 22 and a barrel 24 both of which are hollow and substantially cylindrical. The cap 22 includes a beveled nozzle or applicator tip 26 and a plurality of flutes 28 about the exterior of the cap. The flutes 28 provide a finger grip for turning, pulling or pushing the cap 22 relative to the barrel 24.

The barrel 24 includes a smooth cylindrical portion 30 and a fluted portion 32 of slightly less diameter than the smooth portion 30. The fluted portion 32 is sized to provide a tight interference fit within the tip 12 of a cartridge such that the barrel 24 can not be rotated after insertion into the tip 12.

At the end furthest from the cap 22, the barrel is terminated with a 45° bevel tip 34. As better illustrated in FIG. 5, the bevel tip 34 pierces and breaks the internal seal 36 of the cartridge 14 as the valve barrel is fully inserted into the tip 12. The shoulder 38 dividing the smooth portion 30 of the barrel 24 from the fluted portion 32 provides a stop against the trimmed end 40 of the tip 12.

The tip 12 is trimmed by the user to the proper length from the cartridge end prior to insertion of the valve 10. As an example, the common two inch diameter cartridge sold in retail stores with a variety of filling materials, has a tip 12 that is slightly tapered for the first two inches from the cartridge end. The tip terminates with a substantially tapered and sealed additional ¾ inch portion. The user cuts the tip about one inch from the cartridge end instead of trimming the tip for conventional use. The user then inserts the valve 10 to the shoulder 38 causing the seal 36 to be pierced. With the valve inserted the overall length of the valve 10 and tip 12 is approximately the length of the original tip.

Figure 4:
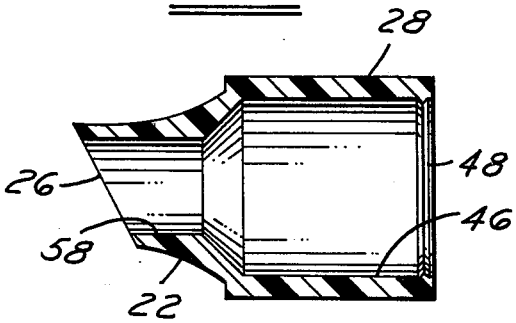
FIG. 4 is a longitudinal section of the valve cap.

Returning to FIGS. 3 and 4, the valve end of the barrel 24 includes a second smooth cylindrical portion 42 of larger diameter than the portion 30 and a second shoulder 44. The internal diameter of the large end or bore 46 of the cap 22 is sized to slideably and sealingly fit over the cylindrical portion 42 of the barrel. An inwardly extending flange 48 at the end of the cap is sized to clear the cylindrical portion 30 of the barrel and to engage the shoulder 44 to form a limit stop as the valve is opened. The plastic materials, such as polyethylene, polypropylene or polystyrene from which the valve is constructed, are sufficiently flexible to permit the cap to be assembled to the barrel by forcing the flange 48 over the cylindrical portion 42 of the barrel.

The valve end of the barrel 24 includes a domed tip 50 and skirt 56 extending therefrom. Four legs 52 forming passages 54 communicating with the interior of the barrel 24 integrally attach the domed tip 50 and skirt 56 to the barrel. The diameter of the domed tip 50 and skirt 56 is sized for an interference fit within the interior bore 58 of the cap applicator tip 26. The domed tip 50 and skirt 56 form the sealing closure for the valve. The cap 22 may be fully rotated relative to the barrel 24 to position the bevel of the applicator tip 26 as desired relative to the cartridge 14 and gun 16.

Figure 5:
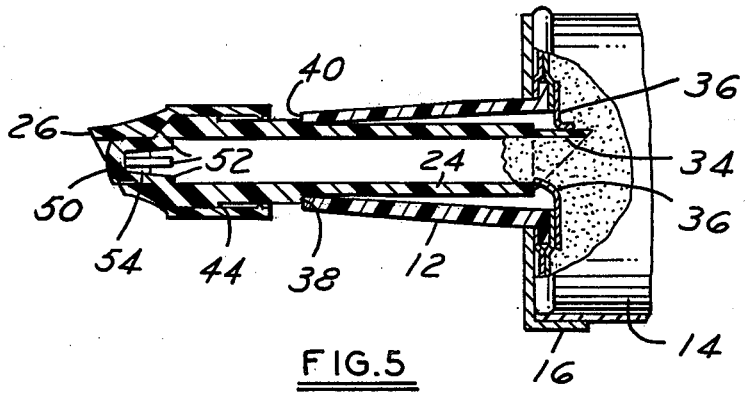
FIG. 5 is a side sectional view of the valve in sealed position and inserted in the cartridge tip.

Referring to FIGS. 5 through 8, the valve is illustrated in four distinct axial positions of the cap 22 relative to the barrel 24. In FIG. 5 the cap 22 is shown in sealed position with the domed tip 50 and skirt 56 extending partially beyond the edge of the applicator tip 26. The skirt 56 completely seals the bore 58 preventing the entrance of air into the cap 22 and thereby preventing the hardening of material within the tip 12 and valve 10. The movement of the cap 22 into the sealed position ejects substantially all of the material above the domed tip 50 from the bore 58 and applicator tip 26 thereby preventing the retention of material at the tip that would otherwise harden and clog the applicator tip 26.

Figure 6:
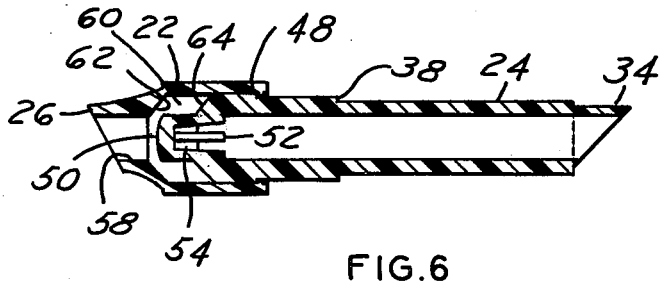
FIG. 6 is a side sectional view of the valve in fully open position.

FIG. 6 illustrates the valve fully open. The flange 48 is in contact with the shoulder 44. The material can pass through the passages 54 into the open space 60 within the cap 22 and between the inner frusto-conical surface 62 of the cap and outer frusto-conical surface 64 of the barrel. The material then can pass beyond the domed tip 50 and through the applicator tip bore 58 for application.

Figure 7:
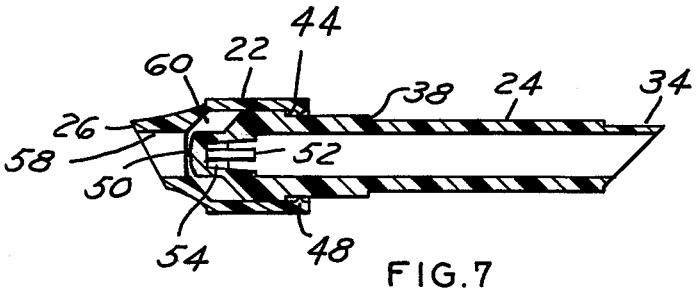
FIG. 7 is a side sectional view of the valve in partially open position; and, FIG. 8 is a side sectional view of the valve in closed position.

FIG. 7 illustrates the valve in partially open position. The material moves through the same path from within the barrel 24 through the bore 58 as in the fully open position, albeit at a slower rate. The bore 46 of the cap 22 and the cylindrical portion 42 of the barrel 24 are sized for a snug fit to retain the cap in position on the barrel as the material passes therethrough. The pressurization of the highly viscous material in the cartridge keeps the cap in partial or fully open position despite back pressure as the material is applied. Momentary contact with a workpiece to which the material is being applied does not cause the valve to close because of the pressurization. Thus, the flow rate of the material can be adjusted with the valve in addition to adjusting the pressurization applied by the gun. The valve is retained in the open or partially open position by the pressure applied to the material.

Figure 8:
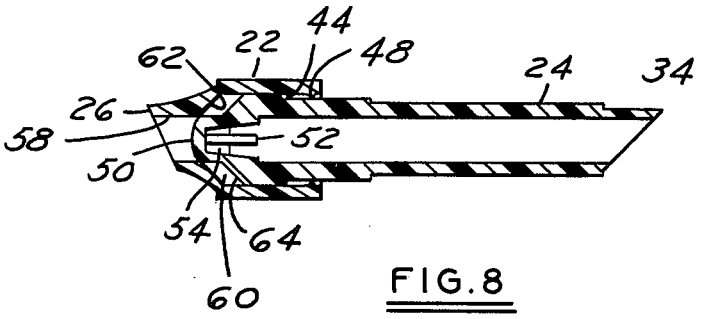

To bring the valve to the closed position shown in FIG. 8, the pressure applied to the cartridge 14 by the handle 18 is released. Release of the handle 18 permits the cap 22 to be closed as shown in FIG. 8 by merely pushing the cap against the workpiece until additional resistance is felt. The plunger rod 20 need not be separately released. The domed tip 50 and skirt 56 contact bore 58 adjacent the inner frusto-conical surface 62 to close the passage to material and create the additional resistance. Material ceases to flow because the additional material pressure applied by the handle 18 which kept the valve open has been released. The residual pressure within the cartridge that normally causes drip from the applicator tip 12 is not sufficient to prevent closure of the valve 10. Thus, the flow of material can be stopped as desired almost instantly during use of the gun. Unintential flow of additional material when the gun is laid aside temporarily and intermittently during use is prevented resulting in lessened wastage and cleanup.

Upon completion of the use of the gun, the cap 22 is pushed down to the position shown in FIG. 5, ejecting the small amount of residue in the applicator tip 26, and tightly sealing the valve and material therein for an indefinite period of time.

Upon exhaustion of the contents of the cartridge 14, the valve 10 can be pulled from the tip 12 and the cap 22 disassembled from the barrel 24 for cleaning. The valve 10 can thereby be reused if so desired.

To reopen the valve from the sealed position, the cap 22 is turned and pulled enough to crack open the annular space 60 between the frusto-conical surfaces 62 and 64. Communication between space 60 and the interior of the barrel 24 is immediately provided by the passages 54 which extend to the frusto-conical surface 64. Pressurization of the cartridge and material therein causes material to flow into the space 60 and act against the frusto-conical surfaces 62 and 64 thereby opening the valve 10.

I claim:

1. A two piece valve to control the flow of viscous materials comprising an elongated barrel including a central opening and piercing means at one end of the barrel; and a cap mounted on the barrel and spaced from the piercing means and movable relative to the barrel between a sealing position wherein fluid flow between said barrel and said cap is sealed close and on an open position wherein there is fluid communication between said barrel and said cap, said cap having a nozzle end with an opening therethrough, said barrel including a dome and a cylindrical skirt extending therefrom and a plurality of legs extending from said skirt to said barrel to define openings for fluid flow between said barrel and said cap, said dome extending substantially through said nozzle end of said cap to eject from said nozzle end substantially all material therein when said cap is in said sealing position.

2. The valve of claim 1 wherein said cap on the barrel may be positioned to close the valve without ejecting material from the valve.

3. The valve of claim 1 wherein said barrel includes longitudinal flutes on the exterior thereof and shoulder means spaced from said piercing means and extending radially beyond said longitudinal flutes.

4. The valve of claim 1 wherein said barrel includes an exterior shoulder spaced from said piercing means and extending radially outwardly relative to the barrel exterior therebetween, the barrel exterior therebetween being sized for an interference fit with the trimmed applicator tip of a caulking tube cartridge.

5. The valve of claim 1 wherein said piercing means comprises the barrel end terminating substantially along a plane intersecting the axis of the barrel at an angle sufficient to form a cutting edge along a portion of the periphery of the barrel end.

6. A two piece valve to control the flow of viscous material comprising an elongated barrel having a cap end, a piercing end and a central opening therethrough, and a cap having an applicator tip and a central opening therethrough, said cap slideably and rotatably attached to one end of said barrel, and, the exterior of said barrel between the ends thereof being divided into three cylindrical segments, the cap end segment being smooth and of greatest diameter, the intermediate segment being smooth and of less diameter than the cap end segment to form a shoulder therewith, and a plurality of longitudinal flutes on the piercing end segment being of less diameter than the intermediate segment to form a shoulder therewith, piercing means extending from the piercing end of said barrel, a frusto-conical surface extending outwardly from the cap end of said barrel, a plurality of legs extending outwardly from the frusto-conical surface to form a plurality of passages communicating with the central opening through said barrel, a dome and a cylindrical skirt extending from said dome, said dome and skirt being attached to said barrel by said plurality of legs, and, the central opening of said cap having a bore of lesser diameter at the applicator tip and a bore of greater diameter at the barrel end of the cap, said two bores being joined by a frusto-conical surface within the cap and, an internally extending flange adjacent the barrel end of the cap, said bore of lesser diameter being sized for an interference fit with the skirt of the barrel and said bore of greater diameter being sized for an interference fit with the cap end segment of said barrel, said flange being adapted to engage the shoulder between said cap end segment and said intermediate segment of said barrel when said valve is fully open.

7. The valve of claim 6 wherein said barrel frusto-conical surface and said cap frusto-conical surface are complementary and said passages are terminated at said barrel frusto-conical surface.

8. The valve of claim 6 wherein the piercing means comprises the barrel end terminating substantially along a plane tilted from the barrel axis at an angle sufficient to form a cutting edge along a portion of the periphery of the barrel end.

9. The valve of claim 6 wherein at least a portion of said dome and skirt extend beyond the applicator tip of said cap when the valve is fully closed.

10. The valve of claim 1 wherein the frusto-conical surface in said cap and the frusto-conical surface on said barrel engage when said valve is fully closed.

* * * * *